US005398731A

United States Patent [19]

Schuster

[11] Patent Number: 5,398,731

[45] Date of Patent: Mar. 21, 1995

[54] LAMELLAR WEFT THREAD BRAKE MECHANISM WITH A VARIABLE BRAKING FORCE

[75] Inventor: Rainer Schuster, Sigmarszell, Germany

[73] Assignee: Lindauer Dornier Gesellschaft mbH, Lindau, Germany

[21] Appl. No.: 204,857

[22] Filed: Mar. 2, 1994

[30] Foreign Application Priority Data

Mar. 5, 1993 [DE] Germany ..... 43 06 911

[51] Int. Cl.[6] ..... D03D 47/34

[52] U.S. Cl. ..... 139/194; 139/450; 242/419.3

[58] Field of Search ..... 139/450, 194; 242/149, 242/150 M, 419.3, 419.4, 422, 422.1, 422.3; 112/254, 255

[56] References Cited

U.S. PATENT DOCUMENTS

| | | | |
|---|---|---|---|
| 3,633,711 | 1/1972 | Pfarrwaller | 242/149 |
| 3,797,426 | 3/1974 | Von Hagen | 242/150 M |
| 4,641,688 | 2/1987 | Gehring . | |
| 4,817,681 | 4/1989 | Krumm et al. . | |
| 5,002,098 | 3/1991 | Desmet et al. | 139/450 |
| 5,179,980 | 1/1993 | Hubner et al. | 139/450 |
| 5,305,966 | 4/1994 | Motta | 242/149 |

FOREIGN PATENT DOCUMENTS

| | | |
|---|---|---|
| 0475892 | 3/1992 | European Pat. Off. . |
| 0524429 | 1/1993 | European Pat. Off. . |

*Primary Examiner*—Andrew M. Falik

*Attorney, Agent, or Firm*—W. G. Fasse; W. F. Fasse

[57] ABSTRACT

In a weft thread brake mechanism with a controllable braking effect, a controllable braking force is applied to a weft thread as it passes between two lamellar braking members, such as leaf spring members. A servomotor, preferably a stepper motor, rotatingly drives an eccentric brake effect control member that cooperates with at least one of the lamellar brake members. Through the eccentric rotation of the braking effect control member, it presses to a varying degree against at least one of the lamellar braking members. Thus, a varying braking force is applied by the lamellar braking members to the weft thread. A programmable computer control provides control signals for the stepper motor.

14 Claims, 2 Drawing Sheets

LAMELLAR WEFT THREAD BRAKE MECHANISM WITH A VARIABLE BRAKING FORCE

FIELD OF THE INVENTION

The invention relates to an improved weft thread brake mechanism with a controllable braking force or effect, especially for shuttleless looms. Such brake mechanisms have a controllable braking effect on each of the weft threads which are individually supplied from weft thread supply spools. Each weft thread passes between two brake members which press against each other. Controllable means act on at least one of the brake members to control the position of the braking members relative to each other and thereby control the braking effect.

BACKGROUND INFORMATION

Such weft thread brakes are used in shuttleless looms for enabling the weft thread insertion devices, such as gripper rods, to select the intended weft thread out of a plurality of weft threads while the selected weft thread is held in a tensioned or stretched condition. The weft thread insertion members, for example the grippers, which are inserted into and withdrawn from respective opposite sides of the loom shed, are subject to substantial accelerations and decelerations during the weft thread insertion. After a presented weft thread has been seized by an insertion gripper, the thread is transported very rapidly to the center of the loom shed. As a result, the thread is rapidly reeled off the supply spool. At the center of the loom shed, the weft thread is transferred from the inserting gripper to the withdrawing gripper, which has moved into the loom shed from the opposite side. During the transfer, the just mentioned rapid thread insertion is briefly interrupted. However, directly following the transfer, the thread, now held by the withdrawal gripper, is again pulled at a high speed completely through the loom shed. Once the thread has been pulled completely through the loom shed, the thread is released by the gripper at the end of the insertion path, whereby the thread is stopped. In this type of thread insertion, it is important that the weft thread remains taut during the entire time of thread insertion, even, for example, during the brief interruption of the thread insertion operation during the thread transfer from one gripper to the other and when the thread is stopped once it has passed completely through the loom shed. It is necessary to keep the thread taut at all times to avoid so-called thread overrun or a continuing following motion of the thread, which could result in the formation of undesirable loops or tangles in the thread, for example.

Weft thread brakes are conventionally used to avoid the above described formation of loops or tangles. Often, such conventional brakes apply a continuous uniform braking effect to the weft thread. Alternatively, these brakes may be equipped to apply a varying braking effect, that is a braking effect of different strengths, to the thread during the different phases of the weft thread insertion. For example, German Patent Publication (DE-PS) 3,446,567 (May 7, 1986) and corresponding U. S. Pat. No. 4,641,688 (Gehring) (Feb. 10, 1987) discloses a weft thread brake having a stepwise controllable braking effect, for use in shuttleless weaving machines. The disclosed controllable weft thread brake includes two lamellar brake members weft are pressed against each other in the manner of leaf springs. A weft thread pulled from a supply spool is pulled between the two lamellar braking members to apply a braking effect thereto. The spring force of the lamellar braking members pressing against each other defines a base level of the braking effect. The disclosed brake further includes controllable means for controllably increasing the braking effect applied by the lamellar braking members. For example, an electromagnet is disclosed for selectively applying an additional braking or clamping force to the lamellar braking members.

U.S. Pat. No. 4,817,681 (Krumm et al.) (Apr. 4, 1989) discloses another weft thread brake that is controllable in a stepwise manner. The disclosed thread brake uses at least one leaf spring brake element for each weft thread and a common control rail that is activated simultaneously for all leaf springs for pressing the respective weft thread against the respective leaf spring. It has been found that improvements can be made over the weft thread brakes disclosed in U. S. Pat. Nos. 4,817,681 and 4,641,688, especially to achieve an improvement in the adjustability, accuracy, and reproducibility of braking effect settings.

European Pat. Application No. 0,475,892 (Huebner et al.) (Mar. 18, 1992) discloses a thread brake for looms, wherein a weft thread passes between a resilient or flexible brake band and a controllably movable brake shoe body. The brake shoe body can be moved by a servomotor connected to a control and logic circuit and acting through a linkage on the brake shoe body. An inductive sensor is required for positioning the servomotor. The rotational motion of the servomotor shaft is converted into a substantially linear or stroke motion of the brake shoe body through the mechanical linkage. The disclosed thread brake is only capable of releasing or not releasing the braking effect, because a base level braking effect is not provided for. Furthermore, the braking force or braking effect applied by the brake in its closed or engaged position can only be adjusted through a mechanical adjustment device. Once a braking effect adjustment has been selected with the mechanical adjustment device, it cannot be changed during the operation of the loom.

European Pat. Application No. 0,524,429 (Jan. 27, 1993) discloses another thread brake mechanism, especially for use in connection with weft thread insertion in power looms. The disclosed thread brake mechanism includes a shaft, which is rotationally driven by a motor and which has a notch or recess cut out of a portion of its circumference. A flexible tongue, such as a spring tongue, is arranged to press radially against the rotating shaft in an axial region including the cut-out notch in the shaft. The weft thread passes between the spring tongue and the rotating shaft, whereby a cyclically alternating braking effect is applied to the thread. Namely, when the shaft rotates into a position allowing the thread to pass through the cut-out notch, essentially no braking effect is applied and a thread, even including knots, can pass through unhindered. As the shaft rotates further, the cut-out notch turns away and the string is held between the shaft and the spring tongue to apply a braking effect. It is a disadvantage of the disclosed thread brake that only two braking control states exist, namely the thread is allowed to run freely through the cut-out notch without any braking effect or the thread is squeezed between the rotating shaft and the spring tongue to effect braking.

OBJECTS OF THE INVENTION

In view of the above it is the aim of the invention to achieve the following objects singly or in combination:

- to improve a thread brake mechanism to insure that a weft thread remains properly tensioned during all phases of a weft thread insertion;
- to achieve a thread braking effect that may be adjusted with high precision to a number of distinct steps of narrow tolerance, or to any setting in an almost continuous range of braking forces;
- to allow the accurate repeatable selection or reproducibility of desired braking force settings;
- to allow the braking force applied by a thread brake mechanism to be adjusted during operation of a power loom;
- to allow the braking parameters, such as the braking force, to be controlled by a program or standard pattern; and
- to provide a thread brake mechanism having few moving parts and a low moment of inertia so that especially rapid accelerations and decelerations of the thread can be achieved.

SUMMARY OF THE INVENTION

The above objects have been achieved in a thread brake mechanism according to the invention, wherein the previously known arrangement of two lamellar braking members pressing against each other with the thread passing therebetween has been improved. According to the invention, a disk magnet stepper motor controls the braking force applied to at least one of the lamellar braking members. An eccentric brake control member is arranged on the free end of the stepper motor shaft. The eccentric member may be a circular cylinder arranged off-axis or eccentrically on the stepper motor shaft. The eccentric member cooperates with at least one of the lamellar braking members so that as the stepper motor shaft rotates or rotationally steps to successive positions, the eccentric member applies a varying braking force to the respective lamellar braking member. The stepper motor is actuated or controlled by a programmable thread brake control. Various operating parameters of the stepper motor, such as the respective angular position of the motor shaft, as well as the speed, timing, and sequence of adjustments of the shaft angular position, are controlled by the thread brake control unit according to the prescribed braking program.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
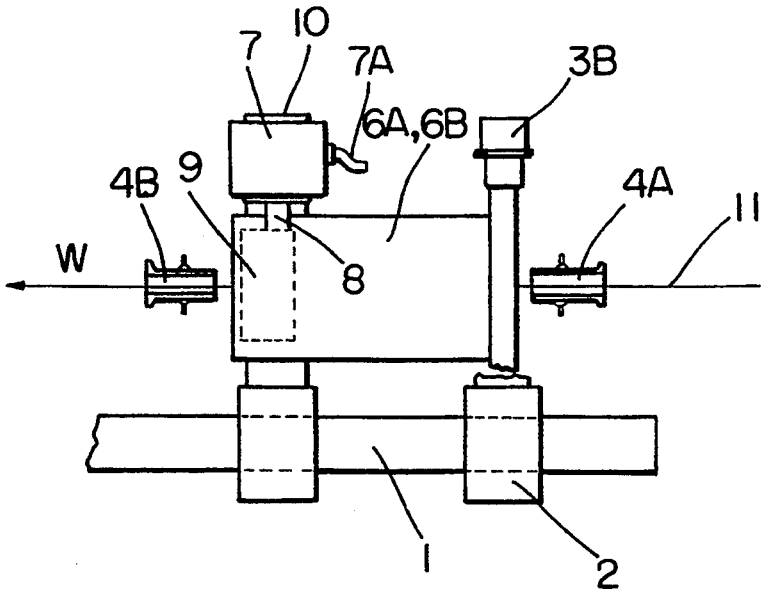
FIG. 1 is a front schematic view of the thread brake mechanism according to the invention.
Figure 2:
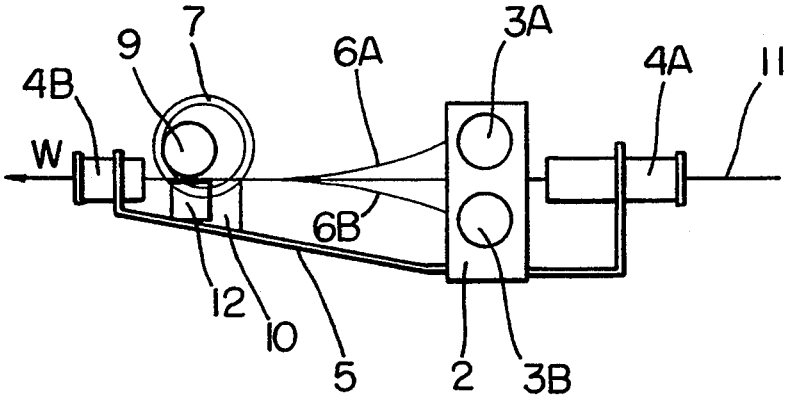
FIG. 2 is a top schematic view of the brake mechanism shown in FIG. 1.

As shown in FIGS. 1 and 2, the thread brake mechanism according to the invention is mounted on a loom by a supporting block 2 attached to a machine frame member 1. Two bolts 3A, 3B, which may be rotatable bolts, are engaged in block 2, for example, by screwing into corresponding holes in block 2. The bolts 3A and 3B respectively hold two lamellar braking members, for example, two leaf springs 6A and 6B. Alternatively, one of the lamellar braking members may be replaced by a brake counter member of a different form, for example, a rigid or flexibly yielding counter surface. A mounting support member 5 carries an intake thread guide eye 4A and an outlet thread guide eye 4B. A weft thread 11 passes through the intake thread guide eye 4A and then between the two lamellar leaf springs 6A and 6B and then passes through the outlet thread guide eye 4B in the direction of arrow W. Note that, for the sake of clarity, FIG. 1 does not show the mounting support member 5.

The leaf springs 6A and 6B, by pressing against each other, apply a braking force or braking effect to the weft thread 11. By adjusting leaf springs 6A and 6B, for example by turning the bolts 3A and 3B, the leaf springs 6A and 6B may be pressed more or less forcefully against each other to adjust the braking force applied to weft thread 11. Leaf springs 6A and 6B may even be completely separated from each other to allow a free run of the weft thread 11 with no braking effect. By adjusting the bolts 3A and 3B to adjust the relative position or pressing force of the leaf springs 6A and 6B, the desired base level setting of the braking effect can be selected.

As further shown in FIGS. 1 and 2, a motor mounting support 10 is attached to the mounting support 5 and carries a servomotor 7 in a fixed position. The servomotor, such as a stepper motor 7, receives electrical power and control signals over an electrical cable 7A as will be described below with reference to FIG. 3. A braking force control member 9, such as an eccentric member 9, is attached to the free end of a shaft 8 of the servomotor 7. The braking force control member 9 is preferably rotationally symmetrical about its own axis, but is arranged off-axis or eccentrically on the shaft 8. For example, the control member 9 may be a circular cylinder that is eccentrically arranged on shaft 8.

The control member 9 is positioned to cooperate with the outer surface of one of the leaf springs, for example, leaf spring 6A as shown here. Thus, as the shaft 8 of servomotor 7 rotates, the eccentric control member 9 presses against the leaf spring 6A to a varying degree, that is to say, the eccentric control member 9 controls the position of leaf spring 6A relative to that of leaf spring 6B. The eccentrically varying pressing by the control member 9 provides a correspondingly varying braking effect to be applied to weft thread 11. An abutment member 12 may be arranged opposite the control member 9 to counter the braking force applied by the control member 9. Abutment member 12 may be a rigid member or a flexible member to resiliently support leaf springs 6A and 6B. Alternatively, leaf spring 6B may be stiffer than leaf spring 6A to counter the applied braking force.

The servomotor 7 is preferably a disk magnet stepper motor which has no magnetic coupling between the respective phases and which has an extremely low moment of inertia because it uses a disk magnet rotor. As a result, the motor and therewith the brake mechanism can be accelerated and decelerated extremely quickly to achieve rapid braking effects and rapid changes in braking level settings. The stepper motor also achieves a very accurate selection of any one of many narrow-tolerance braking levels, because it operates with a step angle of only 3.6°. This achieves a very high resolution of the full range of the braking effect into small steps, i.e. achieving 50 steps through 180° rotation.

Figure 3:
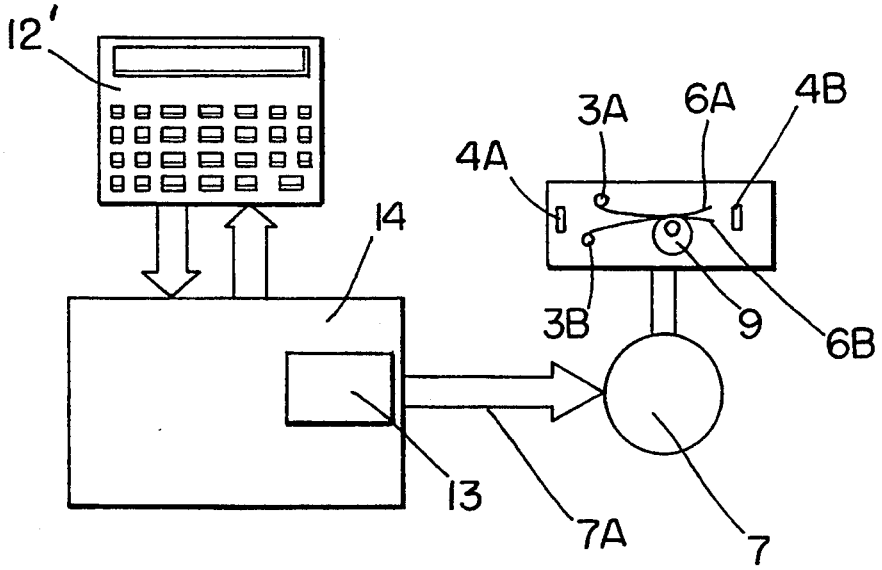
FIG. 3 is a schematic block diagram of the control for the thread brake mechanism according to the invention.

FIG. 3 shows a block circuit diagram for the control of the thread brake mechanism. The desired braking effect parameters, such as the braking force and the timing of its application, are entered or selected as a desired braking effect pattern or program by means of the dialog terminal 121. The dialog terminal 121 is a data input and output terminal, which preferably displays menus from which an operator can select desired parameters and preprogrammed brake control sequences.

The desired braking effect parameters are then provided from the dialog terminal 121 to a thread brake control 13, for example, a microprocessor control circuit that is serially coupled to the loom control 14. The thread brake control 13 then determines and transmits appropriate control signals through the cable 7A to the servomotor 7. The use of dialog terminal 121 together with brake control 13 allows the braking effect to be controlled or adjusted even during operation of the loom and allows a variety of different braking effect sequences to be preprogrammed. This achieves the advantage according to the invention that various braking parameters, such as the braking velocity, can be synchronized with the acceleration and deceleration of the weft thread insertion members, such as the gripper rods. In this manner it is assured that the necessary braking effect is applied and thereby that the necessary thread tension is always maintained. Thus, a too-loose or too-tight thread tension is avoided, and the danger of the thread tangling or ripping is almost completely eliminated.

Figure 4:
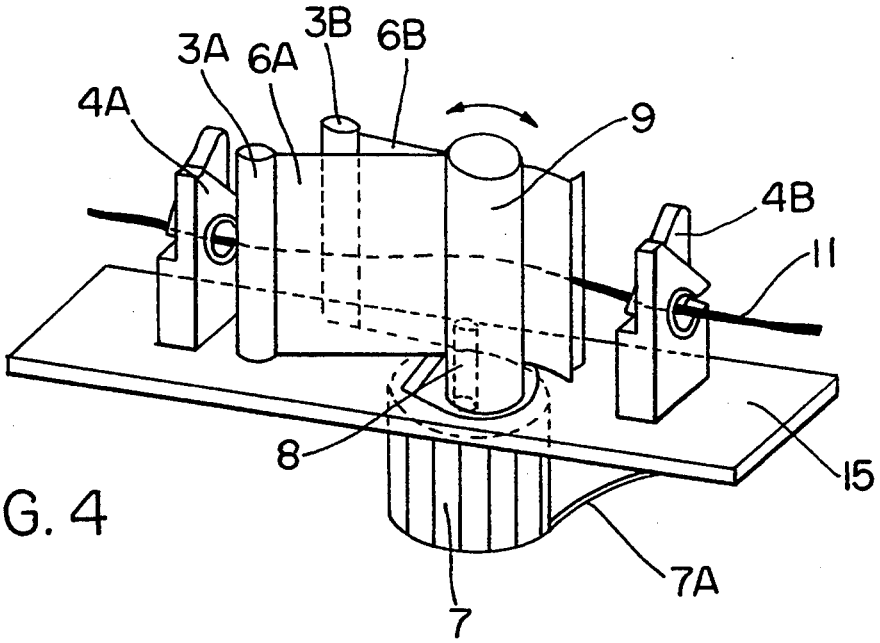
FIG. 4 is a perspective view of an alternative embodiment of a thread brake mechanism according to the invention.

FIG. 4 shows an alternative arrangement of the components of a thread brake mechanism according to the invention. Instead of using a support block 2 for receiving and holding the bolts 3A and 3B, and instead of using a mounting support member 5 for holding the thread guide eyes 4A and 4B as shown in FIGS. 1 and 2 above, the present embodiment provides a single supporting plate 15 on which the bolts 3A and 3B and the thread guide eyes 4A and 4B, as well as the servomotor 7 are commonly mounted. The shaft 8 of the servomotor 7 rotates the eccentric member 9 as in the other embodiments.

Although the invention has been described with reference to specific example embodiments, it will be appreciated that it is intended to cover all modifications and equivalents within the scope of the appended claims.

What is claimed is:

1. A weft thread brake mechanism for applying a controllable braking effect to a weft thread in a loom, comprising a first lamellar brake member, a brake counter member arranged to cooperate with said first lamellar brake member with the weft thread passing between said first lamellar brake member and said brake counter member, a stepper motor having a shaft, an eccentric brake control member mounted on said shaft and operatively contacting said first lamellar brake member, and a programmable brake control connected to said stepper motor for control signal transmission to said stepper motor, whereby through an eccentric rotation of said brake control member a varying brake force is applied to the weft thread by said first lamellar brake member.

2. The brake mechanism of claim 1, wherein said brake counter member comprises a second lamellar brake member.

3. The brake mechanism of claim 2, wherein said first and second lamellar brake members comprise respective first and second leaf springs, and wherein said first and second leaf springs are arranged substantially mirror-symmetrically about a plane through which the weft thread passes.

4. The brake mechanism of claim 2, further comprising an abutment arranged to support said second lamellar brake member against a braking force applied by said eccentric brake control member.

5. The brake mechanism of claim 2, wherein said second lamellar brake member is stiffer than said first lamellar brake member.

6. The brake mechanism of claim 1, wherein said eccentric brake control member is rotationally symmetrical about an axis and is mounted on said shaft eccentrically relative to said axis.

7. The brake mechanism of claim 6, wherein said eccentric brake control member comprises a circular cylinder.

8. The brake mechanism of claim 1, further comprising a base-level braking effect adjuster operatively connected to at least one of said first lamellar brake member and said brake counter member for adjusting a base level contact force between said first lamellar brake member and said brake counter member.

9. The brake mechanism of claim 8, wherein said base-level braking effect adjuster comprises an adjustment bolt arranged to hold said first lamellar brake member in an adjusted position relative to said brake counter member.

10. The brake mechanism of claim 1, wherein said stepper motor is a disk magnet stepper motor.

11. The brake mechanism of claim 1, wherein said stepper motor has a step resolution of about 3.6° for each step.

12. The brake mechanism of claim 1, wherein the loom has a loom control and said programmable brake control comprises a microprocessor control adapted to be connected in series with the loom control.

13. The brake mechanism of claim 1, further comprising a data input and output terminal connected to said programmable brake control.

14. The brake mechanism of claim 13, wherein said data input and output terminal comprises a display screen for displaying program menus presenting program options selectable for programming said programmable brake control.

* * * * *